US006729917B2

(12) United States Patent
Fuse

(10) Patent No.: US 6,729,917 B2
(45) Date of Patent: May 4, 2004

(54) WATER JET PROPULSION APPARATUS

(75) Inventor: Tomohiro Fuse, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/218,603

(22) Filed: Aug. 15, 2002

(65) Prior Publication Data

US 2003/0054706 A1 Mar. 20, 2003

(30) Foreign Application Priority Data

Sep. 18, 2001 (JP) ..... 2001-284067

(51) Int. Cl.[7] ..... B63H 11/08
(52) U.S. Cl. ..... 440/38; 440/47
(58) Field of Search ..... 440/38, 47, 49, 440/83; 114/55.5

(56) References Cited

U.S. PATENT DOCUMENTS 5,618,213 A * 4/1997 Nanami ..... 440/38
5,871,381 A * 2/1999 Lin ..... 440/38
5,975,966 A * 11/1999 Lin ..... 440/47
6,171,158 B1 * 1/2001 Henmi et al. ..... 440/38

FOREIGN PATENT DOCUMENTS

JP 2548210 10/1996

* cited by examiner

*Primary Examiner*—S. Joseph Morano
*Assistant Examiner*—Lars A. Olson
(74) *Attorney, Agent, or Firm*—Birch, Stewart, Kolasch & Birch, LLP

(57) ABSTRACT

To enable a thrust force acting on an impeller shaft to be received by a sufficiently large bearing member. A water jet propulsion apparatus is provided with a stator forming a channel. An impeller is rotatably disposed in the stator. An impeller shaft is rotatably supported by bearing members and provided in front and rear portions of a bearing disposed in the stator and coupled to the rear part of the impeller. The bearing member on the rear side which receives a thrust force of the impeller shaft is larger than the bearing member on the front side. Both of the bearing members and on the front and rear sides are assembled on the bearing from the rear.

16 Claims, 5 Drawing Sheets

FIG. 4(a)
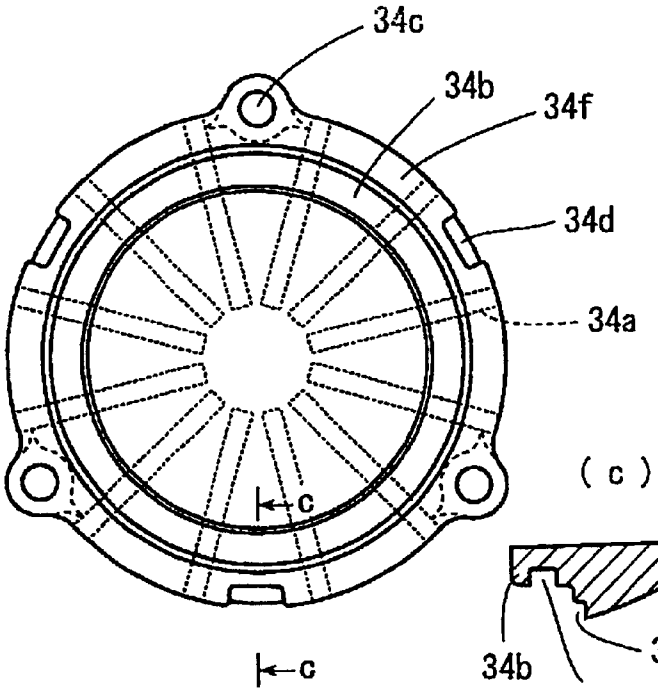
FIG. 4(b)
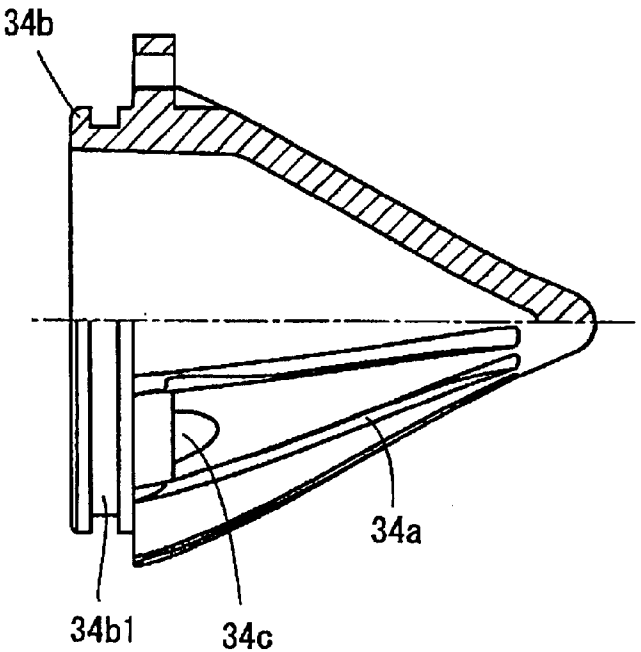
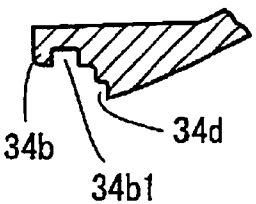
FIG. 4(c)

WATER JET PROPULSION APPARATUS

BACKGROUND OF THE INVENTION

CROSS-REFERENCE TO RELATED APPLICATIONS

The present application claims priority under 35 USC 119 to Japanese Patent Application No. 2001-284067 filed on Sep. 18, 2001 the entire contents thereof is hereby incorporated by reference.

1. Field of the Invention

The present invention relates to a water jet propulsion apparatus for use in a boat. Particularly, the invention relates to a bearing structure of an impeller shaft for supporting an impeller of the water jet propulsion apparatus.

2. Description of Background Art

A known conventional water jet propulsion apparatus is as shown in FIG. 5 (Japanese Utility Model Registration No. 2,548,210).

The water jet propulsion apparatus is attached to the rear portion of a boat body and has a stator (duct) 1 forming a channel, an impeller 2 is rotatably disposed in the stator 1, and an impeller shaft 3 is rotatably supported by bearing members 4 and 5 provided in the front and rear part of a bearing 1*a* disposed in the stator 1 and coupled to the rear part of the impeller 2.

A drive shaft 6 is coupled to the front part of the impeller 2. When the drive shaft 6 is driven by a not-illustrated engine, the impeller 2 is rotated and a water stream is jetted rearwardly in the direction R, thereby propelling the boat body forward F. A thrust force for pulling the impeller shaft 3 forward F acts on the impeller shaft 3.

As is obvious from the shape of the bearing 1*a* shown in the diagram, the bearing member 4 on the front side is assembled to the bearing 1*a* from the front and the bearing member 5 on the rear side is assembled to the bearing 1*a* from the rear, so that the thrust force acting on the impeller shaft 3 is received by the bearing member 5 on the rear side.

More specifically, a flange 3*a* formed in the rear part of the impeller shaft 3 is in contact with an inner race 5*a* of the bearing member 5 and an outer race 5*b* of the bearing member 5 is in contact with a step 1*b* of the bearing 1*a*, so that the thrust force can be received.

The above-described conventional water jet propulsion apparatus has a problems such that, since the bearing members 4 and 5 on the front and rear sides have the same size, the thrust force acting on the impeller shaft 3 cannot be received by a large bearing member.

SUMMARY AND OBJECTS OF THE INVENTION

An object of the present invention is to provide a water jet propulsion apparatus which can solve the above problem and receive a thrust force acting on the impeller shaft by a large bearing member.

To achieve this object, a water jet propulsion apparatus of present invention includes a stator forming a channel, an impeller rotatably disposed in the stator, and an impeller shaft rotatably supported by bearing members provided in front and rear parts of a bearing disposed in the stator and coupled to a rear part of the impeller. The bearing member mounted on the rear side which receives a thrust force of the impeller shaft is larger than the bearing member on the front side.

A water jet propulsion apparatus of the present invention includes the bearing members on the front and rear sides that are both assembled on the bearing from the rear.

The water jet propulsion apparatus of present invention includes a stator forming a channel, an impeller is rotatably disposed in the stator, and an impeller shaft is rotatably supported by bearing members provided in front and rear parts of a bearing disposed in the stator and coupled to a rear part of the impeller. The bearing member on the rear side which receives a thrust force of the impeller shaft is larger than the bearing member on the front side. Consequently, in the water jet propulsion apparatus, the thrust force acting on the impeller shaft can be received by the large bearing member on the rear side.

Also, the bearing member on the front side can be constructed to be smaller than the bearing member on the rear side, so that the size of the bearing of the stator supporting the bearing member does not increase to a great extent. As a result, the size of the water jet propulsion apparatus itself can be prevented from being increased.

As for the water jet propulsion apparatus of the present invention both of the bearing members on the front and rear sides are assembled on the bearing from the rear. Therefore, the following action and effect are obtained.

Since the conventional water jet propulsion apparatus has a configuration such that the bearing member 4 on the front side is assembled to the bearing 1*a* from the front, there is a problem wherein the workability at the time of assembly is very low. Since the impeller 2 is positioned in front of the bearing member 4 on the front side, the drive shaft 6 is coupled in front of the impeller 2 and, further, the engine exists in front of the drive shaft 6, the assembly workability of the bearing member 4 on the front side is very low and it is consequently difficult to perform maintenance.

In contrast, in the water jet propulsion apparatus of the present invention, both of the bearing members on the front and rear sides are assembled to the bearing from the rear, so that a remarkably improved assembly workability is provided as compared with the conventional technique. Accordingly, an effect of facilitated maintenance is also obtained.

In the configuration where both of the bearing members on the front and rear sides are assembled to the bearing from the rear as described above, if the bearing member on the front side is also a large bearing member like the bearing member on the rear side, the size of the bearing increases and, as a result, a problem results in that the size of the water jet propulsion apparatus also increases. However, in the water jet propulsion apparatus of the present invention, the bearing member on the front side can be constructed to be smaller than the bearing member on the rear side. Thus, the size of the bearing of the stator supporting the bearing member does not increase to a great extent and the size of the water jet propulsion apparatus itself can be consequently prevented from being increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4(*a*) to 4(*c*) are a front view (seen from the front of the boat body), a partly-cutaway right side view, and a cross section taken along line c—c in FIG. 4(*a*), respectively, each showing a cap 34.

DETAILED DESCRIPTION OF THE PREFERRED EMBODIMENTS

An embodiment of the invention will be described hereinbelow with reference to the drawings.

Figure 1:
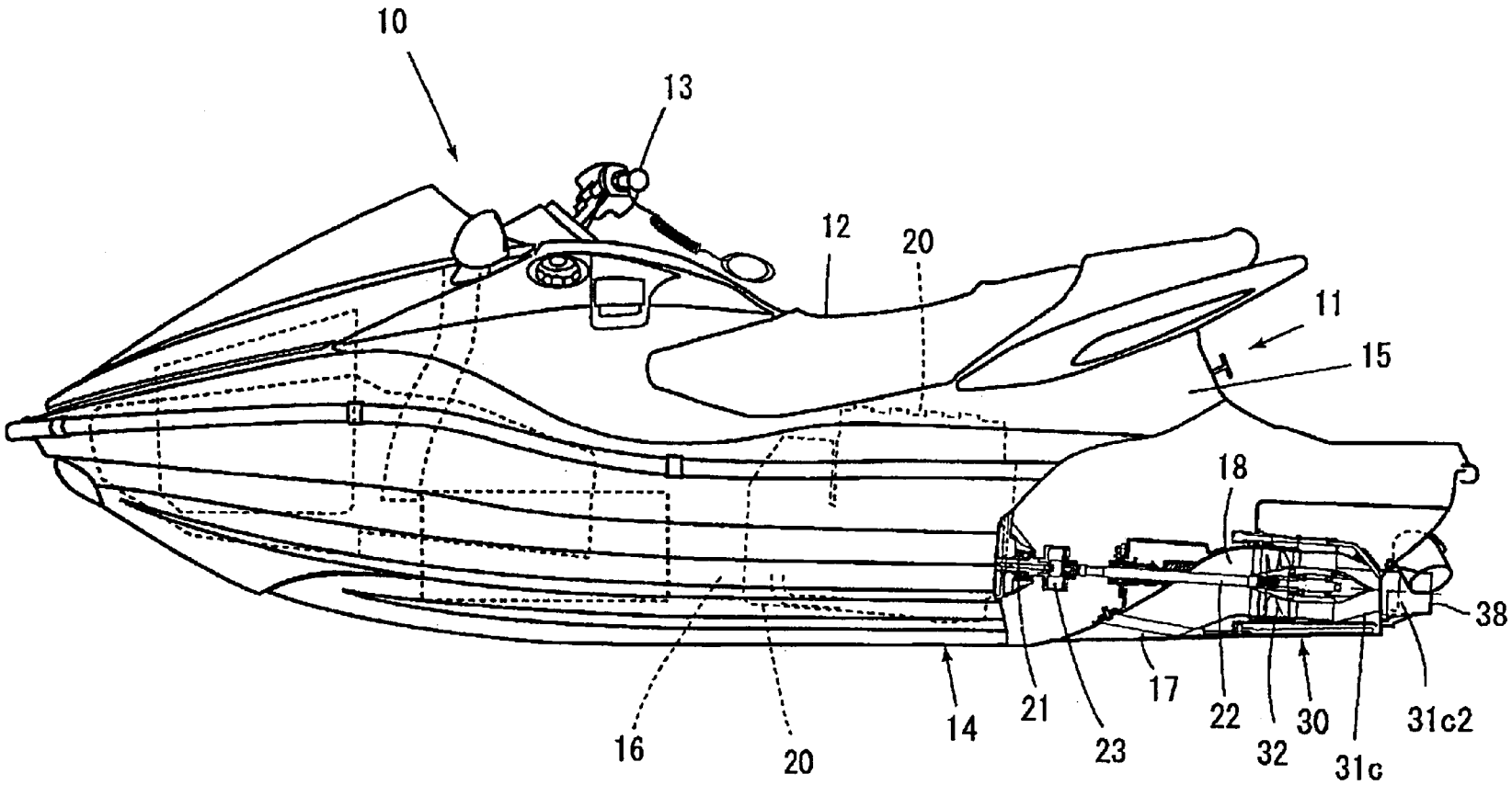
FIG. 1 is a partly-cutaway schematic side view showing an example of a small planing boat using an embodiment of a water jet propulsion apparatus according to the present invention.
Figure 2:
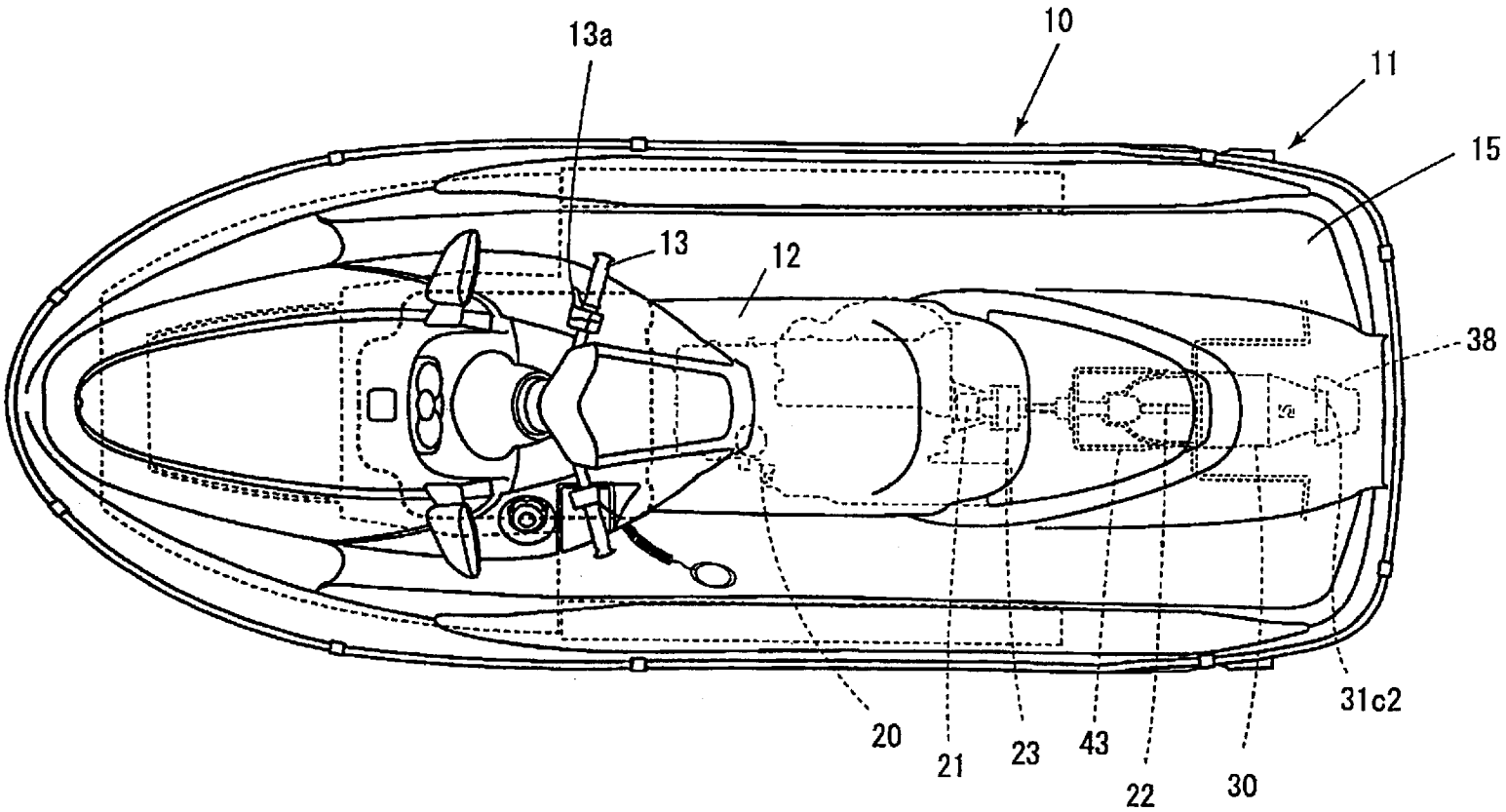
FIG. 2 is a schematic plan view of the small planing boat.

FIGS. 1 and 2 are a partial cutaway schematic side view and a schematic plan view each showing an example of a small planing boat using an embodiment of the water jet propulsion apparatus according to the present invention.

As shown in the drawings (mainly FIG. 1), a small planing boat 10 is a saddle-type small boat. An occupant sits on a seat 12 of a boat body 11, and can drive the small planing boat 11 by gripping a steering handle 13 with a throttle lever.

The boat body 11 has a floating body structure obtained by bonding a hull 14 and a deck 15 and forming a space 16 on the inside. In the space 16, an engine 20 is mounted on the hull 14, and a water jet propulsion apparatus (hereinbelow, also called a jet pump) 30 as a propulsion means driven by the engine 20 is provided in the rear part of the hull 14.

The jet pump 30 has an impeller 32 disposed in a channel 18 extending from an intake 17 opened in the bottom of the boat to a jet port 31*c*2 opened in the rear end of the boat and a deflector 38. A shaft (drive shaft) 22 for driving the impeller 32 is coupled to an output shaft 21 of the engine 20 via a coupler 23. Therefore, when the impeller 32 is rotated by the engine 20 via the coupler 23 and drive shaft 22, water taken from intake 17 is jetted from the jet port 31*c*2 to the outside via the deflector, thereby propelling the boat body 11. The number of revolutions of the engine 20, that is, the propulsion generated by the jet pump 30 is controlled by an operation of turning a throttle lever 13*a* (refer to FIG. 2) of the steering handle 13. The deflector 38 is linked with the steering handle 13 via a not-illustrated control wire and is turned by the operation of the handle 13, thereby enabling the course of the boat body 11 to be changed.

Figure 3:
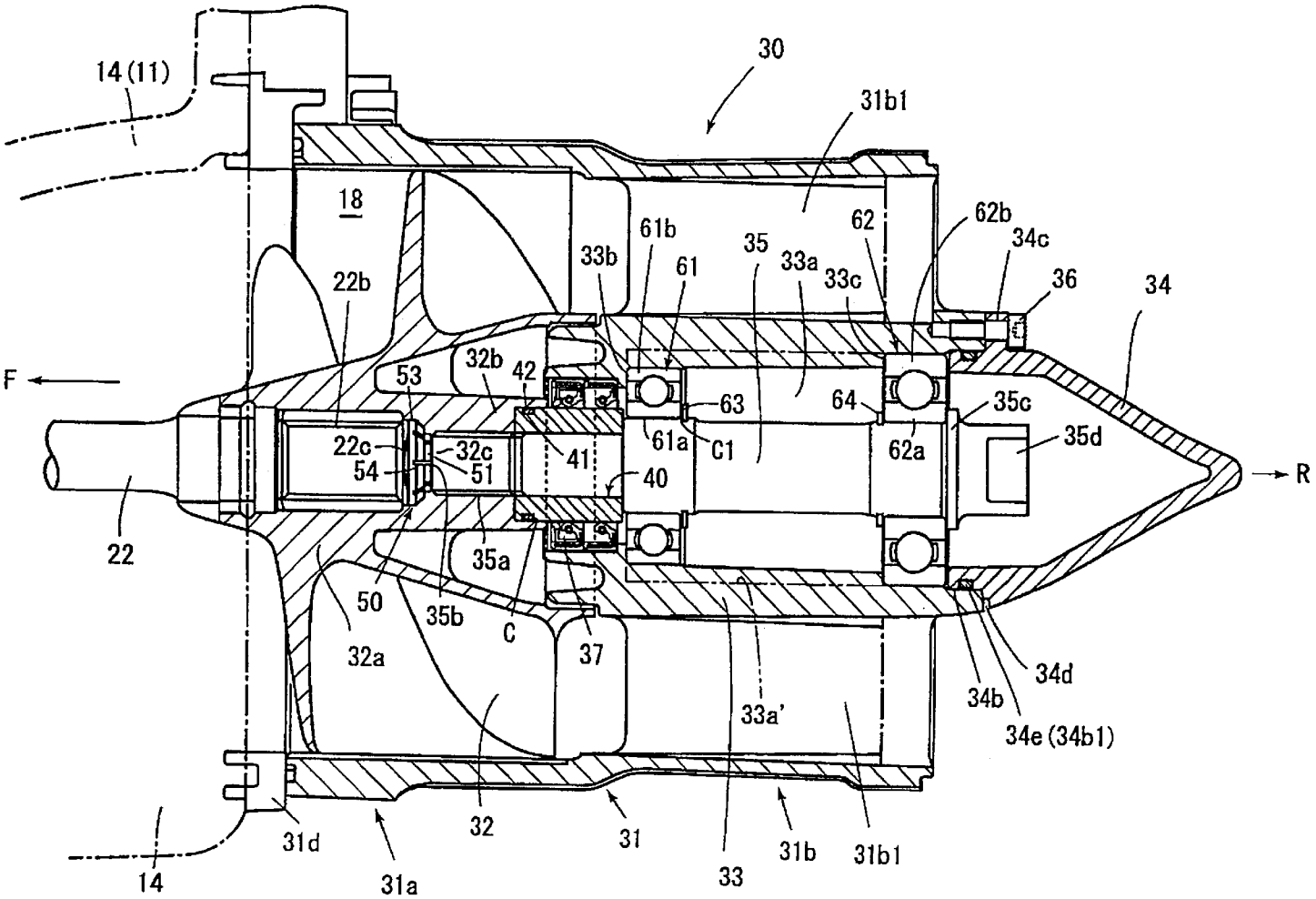
FIG. 3 is a cross section showing a jet pump 30.
Figure 5:
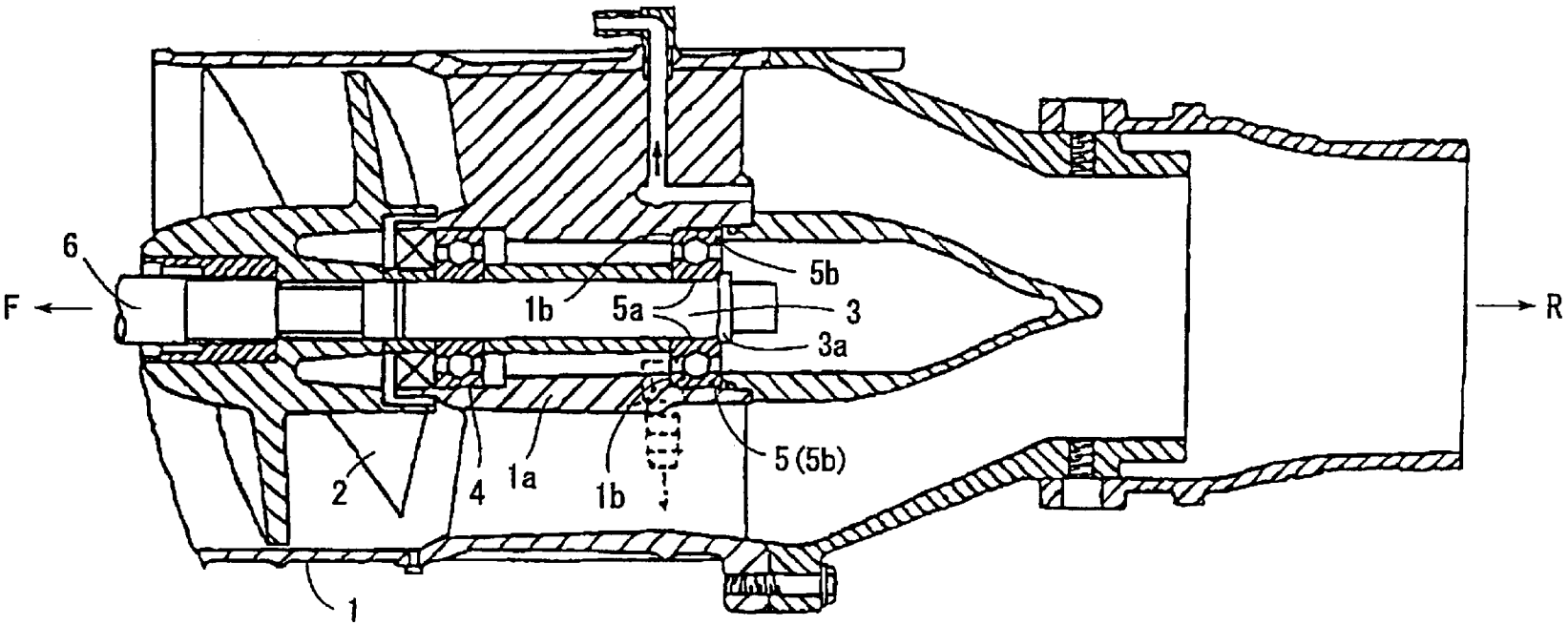
FIG. 5 PRIOR ART
FIG. 5 is a diagram for explaining a prior art.

FIG. 3 is a cross section showing the jet pump 30.

As shown in the diagram, the jet pump 30 has a stator (duct) 31 forming the channel 18 communicated with the intake 17 (refer to FIG. 1) provided on the bottom of the boat body 11. The impeller 32 is disposed in the stator 31 with a bearing 33 of the impeller provided in the stator 31 and a cap 34 for closing the rear end of the bearing 33.

The jet pump 30 is detachably attached to the hull 14 by fixing a flange 31*d* formed in the front portion of the stator 31 by a not-shown bolt.

The stator 31 has an impeller housing part 31*a*, a bearing housing part 31*b*, and a nozzle part 31*c* (refer to FIG. 1). The impeller housing part 31*a* and the bearing housing part 31*b* are formed integrally. The bearing 33 is integrally formed in the bearing housing part 31*b* via a stationary blade 31*b*1.

The front part of a boss 32*a* of the impeller 32 is engaged with a spline 22*b* formed in the rear end of the drive shaft 22, so that the impeller 32 rotates with the drive shaft 22. The front end 22*a* of the drive shaft 22 is coupled to the output shaft 21 of the engine 20 mounted on the boat body 11 via the coupler 23 (FIG. 1).

On the other hand, an impeller shaft 35 for supporting the rear part 32*b* of the boss 32*a* of the impeller 32 is supported so as to be rotatable (revolvable) by a bearing 33 via bearing members (ball bearings in the drawing) 61 and 62 on the front and rear sides. A male screw 35*a* is formed at the tip of the impeller shaft 35 and is screwed in a female screw formed in the boss rear part 32*b* of the impeller 32, thereby coupling the impeller 32 and the impeller shaft 35.

Therefore, the front part of the boss 32*a* of the impeller 32 is coupled to the shaft 22, the rear part 32*b* of the boss is coupled to the impeller shaft 35, and the impeller 32 rotates with the drive shaft 22 and the impeller shaft 35.

As described above, the drive shaft 22 is driven by the engine 20 to rotate the impeller 32, so that the water stream is jetted rearwardly in the direction R, thereby propelling the boat body 11 forwardly in the direction F. Consequently, a thrust force pulling the impeller shaft 35 forwardly in the direction F acts on the impeller shaft 35.

In the embodiment, as will be described in detail, the bearing member 62 on the rear side which receives the thrust force of the impeller shaft 35 is constructed to be larger than the bearing member 61 on the front side.

A collar 40 is attached to the periphery of the impeller shaft 35, and a waterproof seal 37 is provided between the collar 40 and the bearing 33 of the stator. Therefore, water does not enter the bearing 33 from the gap between the bearing 33 and the collar 40.

The collar 40 is also coupled to the rear part 32*b* of the boss of the impeller 32 via a waterproof seal 42. Therefore, water does not enter from the gap C between the collar 40 and the rear part 32*b* of the boss of the impeller 32 toward the peripheral face of the impeller shaft 35.

The waterproof seal 42 takes the form of an O ring attached to a ring-shaped groove 41 formed in the peripheral face of the collar 40.

In the boss 32*a* of the impeller, a buffer 50 for the rear end 22*c* of the drive shaft is provided between the front end 35*b* of the impeller shaft 35 and the rear end 22*c* of the drive shaft 22. The peripheral portion of the buffer 50 is formed in a shape such that air escapes from the impeller shaft 35 side toward the drive shaft 22 side when said impeller shaft 35 is screwed in the boss 32*a* of the impeller.

Concretely, the buffer 50 is made of rubber.

The buffer 50 has an engagement part 51 with a screw hole 32*c* in the boss 32*a* of the impeller and a large diameter part 53 closely attached to the internal face of the boss 32*a* of the impeller. An air escape groove 54 is formed that extends from an external face 52 of the engagement part 51 to some midpoint of the large diameter part 53.

When an air escape groove 54 is formed, at the time of screwing the impeller shaft 35 into the boss 32*a* of the impeller, air (or grease) existing between the front end 35*b* of the impeller shaft and the buffer 50 is guided to the air escape groove 54 in association with the screwing of the impeller shaft 35 and escapes from the front end portion 55 of the air escape groove 54 toward the drive shaft 22 side while slightly deforming the large diameter part 53. Since the drive shaft 22 and the impeller shaft 35 are splined, the air (or grease) can escape along the spline.

After screwing the impeller shaft 35 into the boss 32*a* of the impeller, the large diameter part 53 of the buffer 50 is closely attached to the internal face of the boss 32*a* of the impeller. Consequently, the buffer 50 also plays the role of interrupting water entering from the drive shaft 22 side to the impeller shaft 35 side.

As shown in FIGS. 4(*a*) to 4(*c*), a plurality of (12 in the diagram) stream straightening grooves 34*a* are formed in the external face of the cap 34.

In the front part of the cap 34, a (cylindrical) insertion part 34*b* to the rear part of the bearing 33 is formed. Between the stream straightening grooves 34*a*, three insertion holes 34*c* of screws 36 (refer to FIG. 3) are formed. An attachment groove 34*b*1 of an O ring 34*e* (refer to FIG. 3) is formed in the cylindrical insertion part 34*b*.

Therefore, the cap 34 is attached to the rear part of the bearing 33 by attaching the O ring 34*e* to the cylindrical insertion part 34*b*, inserting (force-fitting) the insertion part 34*b* into the rear part of the bearing 33 as shown in FIG. 3, and screwing the insertion part 34*b* with the screws 36.

In a state where the cap is attached, invasion of water to the bearing 33 is interrupted by the O ring 34*e*.

In a contact face 34*f* with the bearing 33 of the cap 34, three partial notches 34*d* are formed between the stream straightening grooves 34*a*. At the time of maintenance, the cap 34 can be easily detached by unscrewing the screws 36 and inserting the tip of a tool (for example, a driver) into the notches 34*d*.

In a state where the cap 34 is detached, the impeller shaft 35, front and rear bearing members 61 and 62, and collar 40 are integrally assembled to the bearing 33 from the rear.

More specifically, as shown in FIG. 3, a cylindrical bearing housing 33*a* for housing the bearing members 61 and 62 is formed in the bearing 33. A first step 33*b* is formed in the front part of the bearing housing 33*a* and a second step 33*c* having a diameter larger than that of the first step 33*b* is formed in the rear part.

The collar 40 and the bearing member 61 on the front side are attached to the front part of the impeller shaft 35, and the bearing member 62 on the rear side is attached to the rear part. A snap ring 63 is mounted on the rear side of the bearing member 61. A snap ring 64 is mounted on the front side of the bearing member 62.

Since a flange 35*c* is integrally formed in the rear part of the impeller shaft 35, the bearing member 62 on the rear side, snap ring 64 for the bearing member 62, snap ring 63 for the bearing member 61 on the front side, bearing member 61 on the front side, and collar 40 are sequentially attached to the impeller shaft 35 in this order in advance (before the impeller shaft 35 and the like are assembled into the bearing 33), and this assembly is attached to the bearing 33 from the rear.

As a flat portion 35*d* for a tool is formed at the rear end of the impeller shaft 35, by using the flat portion 35*d* (by engaging a tool with the flat portion 35*d*), the impeller shaft 35 is rotated to screw and fasten the male screw 35*a* at the front end of the impeller shaft 35 into the female screw formed in the boss rear part 32*b* of the impeller 32, the assembly constructed by the impeller shaft 35 and the like is attached to the bearing 33.

In the attached state, the bearing member 61 on the front side is positioned between the first step 33*b* and the snap ring 63 in the bearing 33, and a gap C1 is formed between an inner race 61*a* of the bearing member 61 on the front side and the snap ring 63. Therefore, a pulling force (thrust force) from the impeller 32 acting on the impeller shaft 35 does not basically act on the bearing member 61 on the front side.

On the other hand, the rear portion of an inner race 62*a* of the bearing member 62 on the rear side comes into contact with the flange 35*c* of the impeller shaft 35, the front part of an outer race 62*b* comes into contact with the second step 33*c*, and the bearing member 62 on the rear side is tightly sandwiched between the flange 35*c* and the second step 33*c*. Therefore, the pulling force (thrust force) from the impeller 32 acting on the impeller shaft 35 acts on the bearing member 62 on the rear side and is received by the bearing member 62 on the rear side (that is, by the second step 33*c*).

Consequently, in the embodiment, as described above, the bearing member 62 on the rear side which receives the thrust force of the impeller shaft 35 is constructed to be larger than the bearing member 61 on the front side.

The water jet propulsion apparatus as described above produces the following actions and effects.

The water jet propulsion apparatus includes the stator 31 forming a channel, the impeller 32 rotatably disposed in the stator 31, and the impeller shaft 35 rotatably supported by the bearing members 61 and 62 provided in the front and rear parts of the bearing 33 disposed in the stator 31 and coupled to the rear part of the impeller 32. The bearing member 62 on the rear side which receives a thrust force of the impeller shaft 35 is larger than the bearing member 61 on the front side. Consequently, the thrust force acting on the impeller shaft 35 can be received by the large bearing member 62 on the rear side.

Also, the bearing member 61 on the front side can be constructed to be smaller than the bearing member 62 on the rear side, so that the size of the bearing 33 of the stator 31 supporting the bearing member 61 does not increase to a great extent. As a result, the size of the water jet propulsion apparatus 30 itself can be prevented from being increased.

Since both of the bearing members 61 and 62 on the front and rear sides are assembled on the bearing from the rear, the following action and effect are obtained.

Specifically, the conventional water jet propulsion apparatus has a configuration such that the bearing member 4 on the front side is assembled to the bearing 1*a* from the front. Thus, a problem results in that the workability at the time of assembly is very low. Since the impeller 2 is positioned in front of the bearing member 4 on the front side, the drive shaft 6 is coupled in front of the impeller 2. Further, the engine exists in front of the drive shaft 6. Thus, the assembly workability of the bearing member 4 on the front side is very low and it is consequently difficult to perform maintenance.

In contrast, in the water jet propulsion apparatus of the present invention, both of the bearing members 61 and 62 on the front and rear sides are assembled on the bearing 33 from the rear. Thus, a remarkably improved assembly workability is provided as compared with that of the conventional technique. Accordingly, the present invention has the effect of facilitating maintenance.

In the configuration wherein both of the bearing members 61 and 62 on the front and rear sides are assembled on the bearing 33 from the rear as described above, if the bearing member 61 on the front side is also a large bearing member like the bearing member 62 on the rear side, it is necessary to form the bearing housing so as to have a larger diameter from the rear portion to the front portion as shown by an imaginary line 33*a*' in FIG. 3. Consequently, the size of the bearing 33 increases and, as a result, a problem results in that the size of the water jet propulsion apparatus also increases. However, in the water jet propulsion apparatus of the present invention, the bearing member 61 on the front side can be constructed to be smaller than the bearing member 62 on the rear side and, therefore, the thickness of the bearing 33 can be assured. Thus, the size of the bearing 33 does not increase to a great extent and the size of the water jet propulsion apparatus itself can be consequently prevented from being increased.

Since the collar 40 is coupled to the impeller 32 via the waterproof seal 42, water does not enter from the gap C between the collar 40 and the impeller 32 toward the impeller shaft 35.

Therefore, the surface of the impeller shaft 35 does not corrode (or at least does not corrode conspicuously) and, as a result, it is not always necessary to make the impeller shaft of a corrosion-resistant material (such as stainless steel).

Since the impeller shaft 35 can be made of iron or the like, the price of the impeller shaft 35 can be reduced.

Preferably, the collar 40 is made of a corrosion-resistant material (such as stainless steel).

The impeller shaft 35 is coupled to the rear portion of the impeller 32 by screwing, and the drive shaft 22 is coupled to the front portion of the impeller 32 by splining, so that the impeller shaft 35 and the impeller 32 can be detached in a coupled state from the drive shaft 22.

In the embodiment, by detaching the bolt fixing the jet pump 30 to the boat body 11, the whole jet pump 30 can be taken out from the rear side.

Since the buffer 50 for the rear end 22*c* of the drive shaft is provided between the front end 35*b* of the impeller shaft 35 in the impeller 32 and the rear end 22*c* of the drive shaft 22, a shock at the time of attaching the impeller 32 to the rear end 22*c* of the drive shaft is lessened.

In the case of such a configuration, if it is assumed that no countermeasure is taken, at the time of screwing the impeller shaft 35 to the rear part of the impeller 32, air (or grease) existing between the impeller shaft 35 and the buffer 50 cannot escape, and a problem results in that the buffer 50 is excessively deformed.

In contrast, in the water jet propulsion apparatus of the present invention, the peripheral portion of the buffer 50 is formed in a shape such that air escapes from the impeller shaft 35 side toward the drive shaft 22 side when the impeller shaft is screwed. Thus, excessive deformation of the buffer 50 can be prevented.

Although the embodiment of the invention and the example have been described above, the invention is not limited to the foregoing embodiment and example but can be properly modified within the range of the gist of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water jet propulsion apparatus comprising:

a stator forming a channel;

an impeller rotatably disposed in the stator;

an impeller shaft rotatably supported by bearing members provided in front and rear portions of a bearing disposed in said stator and coupled to a rear part of said impeller, said bearing member on the rear side which receives a thrust force of the impeller shaft being larger in size relative to said bearing member on the front side; and a buffer having an air escape groove disposed between a front end of the impeller shaft and a rear end of a drive shaft.

2. The water jet propulsion apparatus according to claim 1, wherein both of said bearing members on the front and rear sides are assembled on said bearing from the rear.

3. The water jet propulsion apparatus according to claim 1, wherein said bearing members include a first roller bearing operatively mounted adjacent to the front portion of said bearing and a second roller bearing operatively mounted adjacent to the rear portion of said bearing.

4. The water jet propulsion apparatus according to claim 1, wherein said bearing includes a first predetermined diameter being formed adjacent to the front portion of said bearing and a second predetermined diameter being formed adjacent to the rear portion of said bearing, said first predetermined diameter accommodating a first bearing member and said second predetermined diameter accommodating a second bearing member, said second bearing member being larger in size relative to said first bearing member.

5. The water jet propulsion apparatus according to claim 4, and further including a first snap ring mounted on the front portion of said bearing for retaining said first bearing member and a second snap ring mounted on the rear portion of said bearing for retaining the second bearing member.

6. The water jet propulsion apparatus according to claim 5, wherein said first snap ring is positioned between said first bearing member and said second bearing member for eliminating a thrust force on said first bearing member.

7. The water jet propulsion apparatus according to claim 6, wherein said second snap ring is positioned between said second bearing member and said first bearing member for imparting a thrust force on said second bearing member.

8. A bearing assembly for a shaft comprising:

a bearing including a front portion and a rear portion;

a first bearing member operatively mounted adjacent to said front portion of said bearing;

a second bearing member operatively mounted adjacent to said rear portion of said bearing;

a first shaft rotatably supported by said first and second bearing members, said second bearing member operatively mounted on the rear portion of said bearing for receiving a thrust force of the shaft being larger in size relative to said first bearing member operatively mounted on the front portion; and a buffer having an air escape groove disposed between a front end of the first shaft and a rear end of a second shaft.

9. The bearing assembly for a shaft according to claim 8, wherein both said first bearing member and said second bearing member are assembled on said bearing from the rear.

10. The bearing assembly for a shaft according to claim 8, wherein said first bearing member includes a first roller bearing operatively mounted adjacent to the front portion of said bearing and said second bearing member includes a second roller bearing operatively mounted adjacent to the rear portion of said bearing.

11. The bearing assembly for a shaft according to claim 8, wherein said bearing includes a first predetermined diameter being formed adjacent to the front portion of said bearing and a second predetermined diameter being formed adjacent to the rear portion of said bearing, said first predetermined diameter accommodating said first bearing member and said second predetermined diameter accommodating said second bearing member, said second bearing member being larger in size relative to said first bearing member.

12. The bearing assembly for a shaft according to claim 11, and further including a first snap ring mounted on the front portion of said bearing for retaining said first bearing member and a second snap ring mounted on the rear portion of said bearing for retaining the second bearing member.

13. The bearing assembly for a shaft according to claim 12, wherein said first snap ring is positioned between said first bearing member and said second bearing member for eliminating a thrust force on said first bearing member.

14. The bearing assembly for a shaft according to claim 12, wherein said second snap ring is positioned between said second bearing member and said first bearing member for imparting a thrust force on said second bearing member.

15. A water jet propulsion apparatus, comprising:

a stator forming a channel;

an impeller rotatably disposed in the stator;

a bearing including a front portion and a rear portion for supporting an impeller shaft;

a first bearing member operatively mounted adjacent to said front portion of said bearing;

a second bearing member operatively mounted adjacent to said rear portion of said bearing;

a shaft rotatably supported by said first and second bearing members; and a first snap ring being mounted rearwardly of the first bearing member, and a second snap ring being mounted forwardly of the second bearing member, a gap being provided between the first bearing member and the first snap ring so that a pulling force of the impeller acting on the impeller shaft does not act on the first bearing member, said second bearing member operatively mounted on the rear portion of said bearing for receiving a thrust force of the shaft being larger in size relative to said first bearing member operatively mounted on the front portion.

16. The water jet propulsion apparatus according to claim 15, wherein both said first bearing member and said second bearing member are assembled on said bearing from the rear.

* * * * *